US011147133B1

(12) United States Patent
Tai et al.

(10) Patent No.: US 11,147,133 B1
(45) Date of Patent: Oct. 12, 2021

(54) LIGHTING DEVICE WITH COLOR TEMPERATURE CONTROL FUNCTION

(71) Applicants: G-TECH LIGHTING TECHNOLOGY (DONGGUAN) CO., LTD., Dongguan (CN); BRIGHTNESS OPTRONICS CO., LTD., Taoyuan (TW)

(72) Inventors: Shih Neng Tai, Taoyuan (TW); Shiou-Liang Yeh, Dongguan (CN); Chang-Ching Lee, Dongguan (CN)

(73) Assignees: G-Tech Lighting Technology (Dongguan) Co., Ltd., Guangdong (CN); Brightness Optronics Co., Ltd., Taoyuan (TW)

( * ) Notice: Subject to any disclaimer, the term of this patent is extended or adjusted under 35 U.S.C. 154(b) by 0 days.

(21) Appl. No.: 17/074,971

(22) Filed: Oct. 20, 2020

(51) Int. Cl.
*H05B 45/10* (2020.01)
*H05B 45/18* (2020.01)
*H05B 47/19* (2020.01)
*H05B 45/325* (2020.01)

(52) U.S. Cl.
CPC ..... *H05B 45/18* (2020.01); *H05B 45/325* (2020.01); *H05B 47/19* (2020.01)

(58) Field of Classification Search
CPC ..... H05B 45/10; H05B 45/18; H05B 45/325; H05B 45/3575; H05B 47/10; H05B 47/19; H05B 41/3924
See application file for complete search history.

(56) References Cited

U.S. PATENT DOCUMENTS 10,136,503 B2 * 11/2018 Chen ..... H05B 39/08
2013/0113394 A1 * 5/2013 Ido ..... H05B 45/50 315/297
2013/0264954 A1 * 10/2013 Chung ..... H05B 45/48 315/186
2014/0062313 A1 * 3/2014 Ootsubo ..... H05B 45/20 315/158
2015/0091472 A1 * 4/2015 Kadotani ..... H05B 45/20 315/294
2017/0027032 A1 * 1/2017 Kong ..... G09G 3/32
2017/0280527 A1 * 9/2017 Lee ..... H05B 45/3575

* cited by examiner

*Primary Examiner* — Thai Pham
(74) *Attorney, Agent, or Firm* — Rosenberg, Klein & Lee

(57) ABSTRACT

The present invention is a lighting device with color temperature control function, including two modulated power input ends, a rectifier that rectifies the modulated power and outputs a rectified modulated power, a first LED module and a second LED module that have different color temperatures, and a dimming control unit. The modulated power includes multiple cycles of a sinewave, and each cycle of the sinewave has a firing angle. The dimming control unit reads a lighting modulation command code that is carried in the modulated power according to the firing angle of each cycle, and controls the luminous intensity of the first and second LED modules respectively to perform a designated combination of color temperature of lighting effect.

10 Claims, 5 Drawing Sheets

LIGHTING DEVICE WITH COLOR TEMPERATURE CONTROL FUNCTION

BACKGROUND OF THE INVENTION

1. Field of the Invention

The present invention relates to a lighting device, especially to a lighting device with color temperature control function.

2. Description of the Related Art

A ceiling fan lighting device is a combination of a ceiling fan and a light, and is often used at home or offices as a designing element for space saving, apparatus simplifying, and decoration purpose. The ceiling fan lighting device usually includes a remote controller, a wireless control module, a fan module, and a lighting module. The fan module and the lighting module of the ceiling fan lighting device are electrically connected to the wireless control module. When the wireless control module receives a wireless fan control signal or a wireless lighting control signal from the remote controller, the wireless control module generates and sends a fan command signal or a lighting command signal, and controls the fan module or the lighting module to perform corresponding acts.

The lighting module often implements a leading-edge modulation method with a Triode AC Semiconductor Switch (TRIAC) component. In short, the leading-edge modulation technique cuts off a specific part of each cycle of the AC power source to modulate the total power that is sent to an LED component, and as a result modulates the average luminous intensity of the LED component. To be more detailed, the lighting module includes a driving unit, a TRIAC component, and multiple LED components.

However, since the luminous intensity of the lighting module is controlled by directly modulating the total input power from the power source, the luminous intensity of every LED component of the lighting module in the lighting device will be controlled altogether, and only the luminous intensity of the whole lighting device may be controlled. Namely, it is not possible to respectively control each LED component for different lighting effects, which is a disadvantage for developing smart appliance in the recent trend of smart home.

SUMMARY OF THE INVENTION

The present invention is a lighting device with color temperature control function, including:

- two modulated power input ends, receiving a modulated power, wherein the modulated power is composed of multiple cycles of a sinewave, and each cycle of the sinewave has a firing angle;
- a rectifier, electrically connected to the modulated power input ends to receive and rectify the modulated power, and having a rectifier output end; a first LED module, electrically connected to the rectifier output end to receive the rectified modulated power;
- a second LED module, electrically connected to the rectifier output end to receive the rectified modulated power; wherein the first LED module and the second LED module have different color temperatures;
- a dimming control unit, electrically connected to the first LED module and the second LED module, and having a power signal input end, wherein the power signal input end is electrically connected to the rectifier output end to receive the rectified modulated power; wherein the dimming control unit reads a lighting modulation command code according to the firing angle of each cycle of the sinewave, and respectively controls luminous intensity of the first LED module and the second LED module, such that the first LED module and the second LED module perform lighting with a specific combination of color temperatures.

The modulated power input ends receive the AC sinewave signal that contains information in the modulation of different firing angles in each cycle. The information assigns the luminous intensity of the first LED module and the second LED module, such that the lighting device performs a lighting of specific total luminous intensity and color temperature combination. For example, when one of the cycles of the modulated power has a first firing angle, the dimming control unit records a first value; when another one of the cycles of the modulated power has a second firing angle, the dimming control unit records a second value. Therefore, the dimming control unit reads the lighting modulation command code that is carried in the modulated power, and further controls the dimming of the first LED module and the second LED module respectively to present different lighting combinations.

By utilizing the power carriage wave technique, the lighting device of the present invention requires no extra signal line or signal input port to receive a command signal. The dimming control unit receives the modulated power directly from the modulated power input end, and controls the first LED module and the second LED module to provide different combinations of luminous intensity and color temperature accordingly. As a result, the lighting device of the present invention improves the adaptability without extra expense and manufacturing cost.

DETAILED DESCRIPTION OF THE INVENTION

Figure 1:
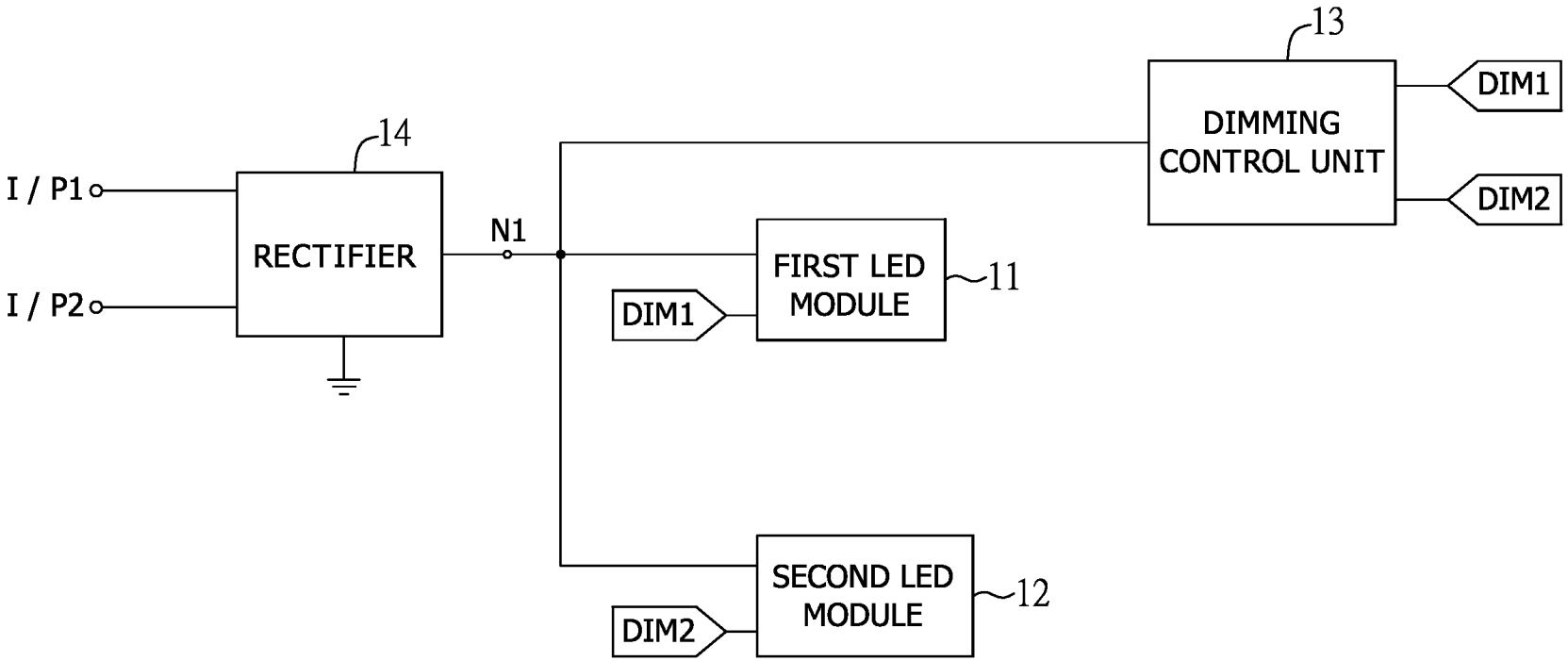
FIG. 1 is a block diagram of the lighting device of the present invention.

With reference to FIG. 1, the present invention is a lighting device with color temperature control function, including two modulated power input ends I/P1, I/P2, a rectifier 14, a first LED module 11, a second LED module 12, and a dimming control unit 13. The modulated power input ends I/P1, I/P2 receive a modulated power, the rectifier 14 is electrically connected to the modulated power input ends I/P1, I/P2 to receive the modulated power, and has a rectifier output end N1. The rectifier 14 rectifies the modulated power and outputs a rectified modulated power through the rectifier output end N1. The modulated power comprises multiple cycles of a sinewave, each cycle having a firing angle. The first LED module 11 and the second LED module 12 are electrically connected to the rectifier output end N1 to receive the rectified modulated power, and the color temperature of the first LED module 11 is different to the color temperature of the second LED module 12. The dimming control unit 13 is connected to the first LED module 11 and the second LED module 12, and has a power signal input end. The power signal input end is also connected to the rectifier output end N1 to receive the rectified modulated power. The dimming control unit 13 reads a lighting modulation command code according to the firing angle of each cycle, and respectively controls the luminous intensity of the first LED module 11 and the second LED module 12, such that the first LED module 11 and the second LED module 12 perform lighting with a specific combination of color temperatures.

Figure 2A:
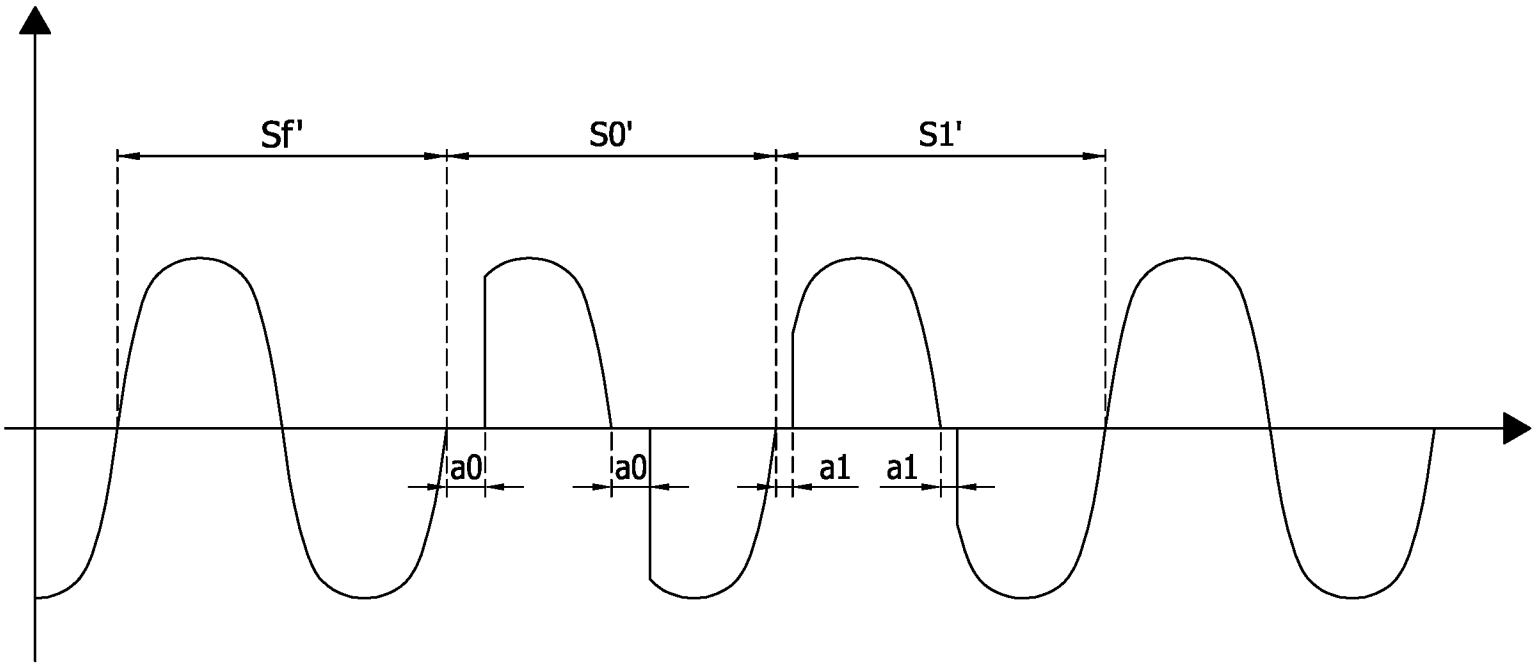
FIG. 2A is a waveform diagram of a modulated power of the present invention.
Figure 2B:
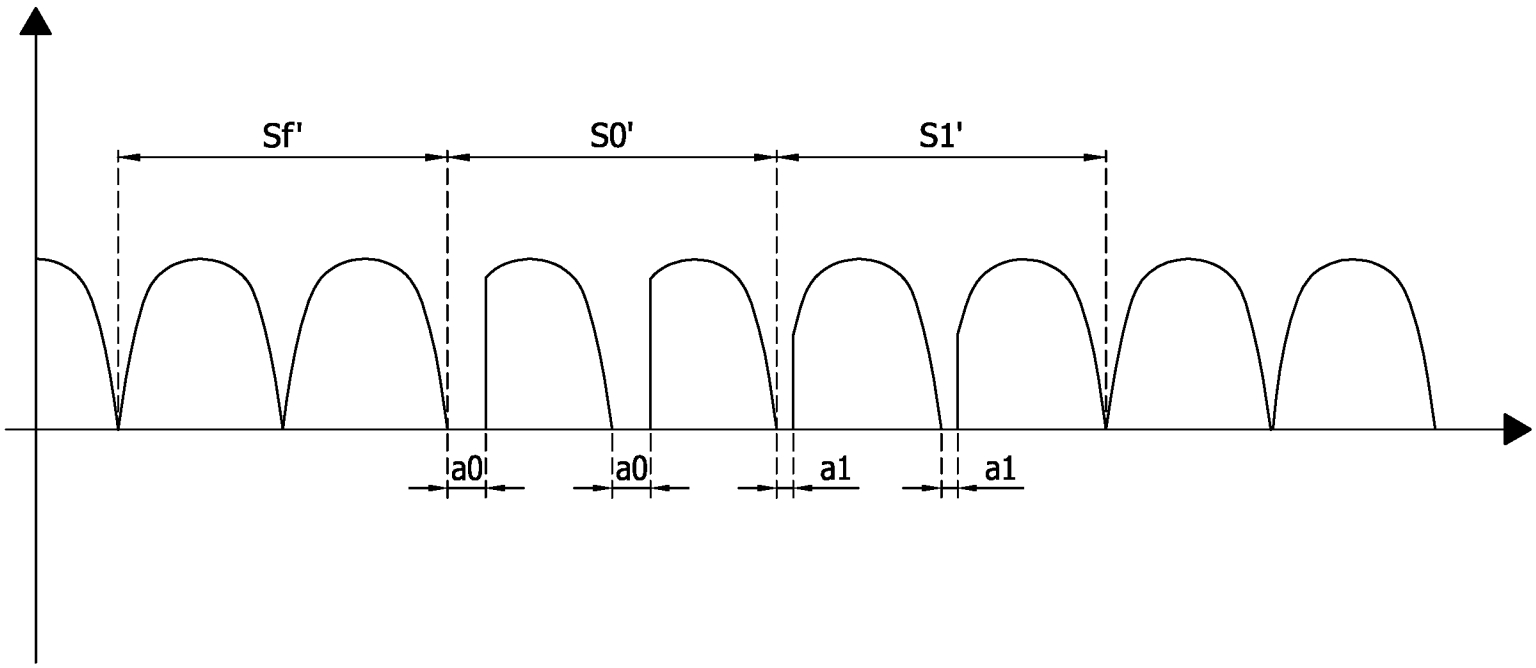
FIG. 2B is a waveform diagram of a rectified modulated power of the present invention.

With reference to FIG. 2A, in an embodiment of the present invention, the firing angle of a cycle S0 of the sinewave may be a first firing angle a0 representing a first value, and the firing angle of another cycle S1 may be a second firing angle a1 representing a second value. Therefore, when the dimming control unit 13 determines the firing angle of the cycle S0 is the first firing angle a0, the dimming control unit 13 records the first value, and when the dimming control unit 13 determines the firing angle of a cycle S1 is a second firing angle a1, the dimming control unit 13 records the second value. With reference to FIG. 2B, wherein FIG. 2B is a waveform diagram of the rectified modulated power.

In the present embodiment, a binary form of command code is demonstrated. The first value may be "0", and the second value may be "1". The dimming control unit 13 records the corresponding bits in the command code. The length of the lighting modulation command code may be designed according to the requirement of the number of different combinations of the illumination intensity and color temperature. If the manufacturer or the designer of the lighting device demands many combinations, a longer lighting combination code may be preset. To interpret the lighting modulation command code, the dimming control unit 13 stores a command chart. When the dimming control unit 13 records the lighting modulation command code, the dimming control unit 13 reads a first lighting control code and a second lighting control code that correspond to the lighting modulation command code in the command chart, generates a first lighting control signal according to the first lighting control code, generates a second lighting control signal according to the second lighting control code, and outputs the first lighting control signal and the second lighting control signal to the first LED module 11 and the second LED. As a result, the first LED module 11 presents a specific luminous intensity of light according to the first lighting control code, and that the second LED module 12 presents a specific luminous intensity of light according to the second lighting control code.

In the embodiment, the modulated power includes at least one cycle Sf of the sinewave that has a firing angle of 0 degree, that is, a complete cycle Sf of sinewave form. When the dimming control unit 13 records a first number of successive cycles Sf of sinewave having a firing angle of 0 degree, the dimming control unit 13 determines the firing angle of the next second number of successive cycles of sinewave, and records the lighting modulation command code of second number bits accordingly. That is, the first number of successive cycles having the firing angle of 0 degree divides the last lighting modulation command code and the present one. Therefore, when the dimming control unit 13 determines that there are a first number of successive cycles having the firing angle of 0 degree, the dimming control unit 13 begins to record the firing angle of the next second number of successive cycles of sinewave as the corresponding values of the second number bits of the lighting modulation command code.

For example, the lighting modulation command code is set to be a 6-bits code, and the number of complete cycles of sinewave to divide two sets of lighting modulation command code is set to be 4. Therefore, when the dimming control unit 13 receives 4 complete cycles of sinewave, that is, 4 cycles of sinewaves with the firing angle of 0 degree, it begins to record the corresponding values of the firing angle of the next 6 cycles as a 6-bits lighting modulation command code.

Figure 3:
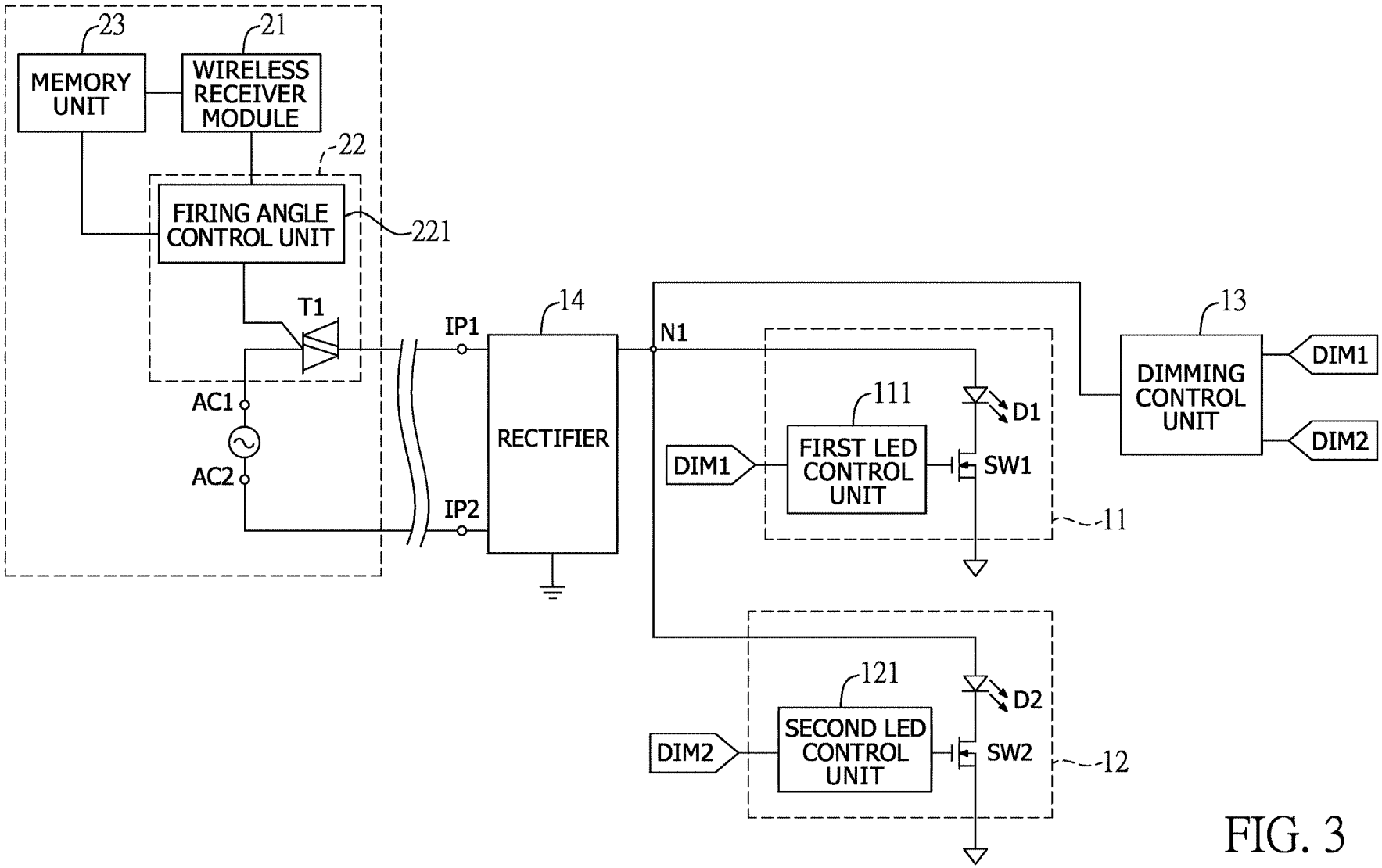
FIG. 3 is a block diagram of a preferred embodiment of the lighting device of the present invention.

With reference to FIG. 3, the first LED module 11 includes a first LED unit D1, a first switch SW1, and a first LED control unit 111. The first switch SW1 is electrically connected with the first LED unit D1 in series between the modulated power input ends and a ground end, and the first switch SW1 has a first control end. The first LED control unit 111 has a first control input end DIM1 and a first control output end, wherein the first control input end DIM1 is electrically connected to the dimming control unit 13, and the first control output end is electrically connected to the first control end of the first switch SW1. Similarly, the second LED module 12 includes a second LED unit D2, a second switch SW2, and a second LED control unit 121. The second switch SW2 is electrically connected with the second LED unit D2 in series between the modulated power input ends and the ground end, and the second switch SW2 has a second control end. The second LED control unit 121 has a second control input end DIM2 and a second control output end, wherein the second control input end DIM2 is electrically connected to the dimming control unit 13, and the second control output end is electrically connected to the second control end of the first switch SW1.

The first LED control unit 111 is connected to the dimming control unit 13 to receive the first lighting control signal, and the second LED control unit 121 is connected to the dimming control unit 13 to receive the second lighting control signal. The first LED control unit 111 and the second LED control unit 121 respectively control the duty ratio of the first switch SW1 and the second switch SW2. For example, the first LED control unit 111 and the second LED control unit 121 may be ORG6612 dimming chips.

With reference to FIG. 3, in the embodiment, the lighting device of the present invention further includes two power input terminals AC1, AC2, a wireless receiver module 21, and a power modulation module 22. The power input terminals AC1, AC2 receive an alternative current (AC) power. The wireless receiver module 21 receives a wireless control signal and generates the lighting modulation command code accordingly. The power modulation module 22 is electrically connected to the power input terminals AC1, AC2 to receive the AC power, is electrically connected to the wireless receiver module 21 to receive the lighting modulation command code, and has two modulated power output ends. The power modulation module 22 controls the firing angle of each cycle of the AC power according to the lighting command code, thus generates the modulated power, and outputs the modulated power to the modulated power output ends.

Preferably, the rectifier 14, the first LED module 11, the second LED module 12, and the dimming control unit 13 are disposed on an LED light board. The wireless receiver module 21 and the power modulation module 22 are integrated in a control module of the ceiling fan lighting device. The LED light board is electrically connected to the control module through two power lines to receive the modulated power.

In the embodiment, the power modulation module 22 includes a triode AC semiconductor switch (TRIAC) T1 and a firing angle control unit 221. The TRIAC T1 is electrically connected between the AC power input terminal and the modulated power output end, and has a control end. The firing angle control unit 221 is electrically connected to the wireless receiver module 21 to receive the lighting modulation command code, and is electrically connected to the control end of the TRIAC T1. When the firing angle control unit 221 receives the lighting modulation command code, and when a first bit of the lighting modulation command code is a first value, the switching control unit provides a PWM signal with a first duty ratio to the control end of the TRIAC T1, such that the TRIAC T1 is conducted at a first firing angle a0 at the present cycle of the sinewave; when the second bit of the lighting modulation command code is a second value, the switching control unit provides a PWM signal with a second duty ratio to the control end of the TRIAC T1 such that the TRIAC T1 is conducted at a second firing angle a1 at the present cycle of the sinewave.

Preferably, the firing angle of each cycle in the modulated power is smaller than a minimum power utilization phase angle. Namely, the first firing angle a0 and the second firing angle a1 are both smaller than the minimum power utilization phase angle, therefore, regardless of the value that each cycle of the sinewave is carrying, the power utilization of the first or second LED module 12 will not be influenced. The power that is actually received by the LED modules while conducted is independent from the firing angle of each cycle.

To be more detailed, the LED units in the first LED module 11 and the second LED module 12 have a minimum forward voltage, and according to the inputted rectified AC voltage, the LED units cannot be conducted before the phase angle of X1 in each cycle due to low voltage. Therefore, the conduction duty ratio of the first LED unit D1 and the second LED unit D2 can only be modulated between the phase angles interval between X1 and X2. In this case, X1 is the minimum power utilization phase angle. Since the first firing angle a0 and the second firing angle a1 that respectively represent the first value and the second value are both smaller than the minimum power utilization phase angle X1, the first LED control unit 111 and the second LED control unit 121 modulate the conducted duty ratio.

Since the first firing angle a0 and the second firing angle a1 do not directly influence the input power to the first and second LED units D1, D2, and are used to represent two different values, the angle of the first and second firing angles a0, a1 can be any two different angles lower than the minimum power utilization phase angle, the corresponding voltage value at such firing angles are also relatively lower. Therefore, when the TRIAC T1 is switched to the conducted phase at the first firing angle a0 or the second firing angle a1, the voltage across the TRIAC T1 is low, thus causing less noise or EMI problem. In the embodiment, the lighting modulation command code may be an illumination assigning code or a color temperature assigning code. The lighting modulation command code includes a header bit to indicate the illumination assigning code or the color temperature assigning code. For example, if the header bit is "0", it indicates that the lighting modulation command code is the illumination assigning code. If the header bit is "1", it indicates that the lighting modulation command code is the color temperature assigning code. When the dimming control unit 13 records the illumination assigning code or the color temperature assigning code, the dimming control unit 13 looks up the command chart for the corresponding luminous intensity for the first LED module 11 and the second LED module 12, and generates the first lighting control signal and the second lighting control signal. Preferably, the first lighting control signal and the second lighting control signal are pulse width modulation (PWM) signals.

For example, when an illumination assigning code corresponds to a luminous intensity of 100%, the dimming control unit 13 generates the first lighting control signal and the second lighting control signal with a 100% duty ratio, and the first LED control unit 111 and the second LED control unit 121 control the first switch SW1 the second switch SW2 to have 100% conduction time, and therefore the first LED unit D1 and the second LED unit D2 provide 100% luminous intensity. When the illumination assigning code corresponds to a luminous intensity of 50%, the dimming control unit 13 generates the first lighting control signal and the second lighting control signal with a 50% duty ratio, and the first LED control unit 111 and the second LED control unit 121 control the first switch SW1 and the second switch SW2 to have 50% conduction time, and therefore the first LED unit D1 and the second LED unit D2 provide 50% luminous intensity. Preferably, the first switch SW1 and the second switch SW2 are metal-oxide-semiconductor field-effect transistor (MOSFET) switches.

The first LED control unit 111 controls the duty ratio of the first switch SW1 with PWM control signals, and therefore controls the average luminous intensity of the first LED unit D1. Similarly and respectively, the second LED control unit 121 controls the duty ratio of the second switch SW2 with PWM control signals, and therefore controls the average luminous intensity of the second LED unit D2. The switching frequencies of the first switch SW1 and the second switch SW2 are independent from the frequency of the modulated power. The switching frequency of the first switch SW1 and the second switch SW2 as MOSFETs can easily reach tens of thousands hertz (KHz). Therefore, even when controlled under low luminous intensity, namely, low duty ratio, visible flickering of the LED units is quite unlikely to occur.

When the lighting modulation command code is the color temperature assigning code, the dimming control unit 13 determines the respective luminous intensity of the first LED module 11 and the second LED module 12. For example, the color temperature of the first LED unit D1 is 3000K, and the color temperature of the second LED unit D2 is 6000K. When the color temperature assigning code corresponds to a 3000K color temperature in the command chart, the dimming control unit 13 maintains the first lighting control signal, and outputs a second lighting control signal that leads to 0% duty ratio of the second switch SW2. As a result, the first LED unit D1 with 3000K color temperature remains its luminous intensity, and the second LED unit D2 with 6000K turns off, and the average color temperature of the lighting device is 3000K.

When the color temperature assigning code corresponds to a combination of 3000K+6000K color temperatures in the command chart, the dimming control unit 13 maintains the first lighting control signal, and generates the second lighting control signal that leads to an equal duty ratio of the second switch SW2. As a result, the first LED unit D1 with 3000K color temperature and the second LED unit D2 with 6000K color temperature provide equal luminous intensity lighting, and the average color temperature of the lighting device as a whole is 3000K+6000K.

The embodiments of dimming control and the color temperature control described above are simply exemplary embodiments. As for dimming control, there could be 0%~100% phase modulation. With a 6-bit illumination assigning code, a 64 phase control can be realized. As for color temperature control, there may be multiple different combinations between the first and second LED units D1, D2. For example, when the first LED unit D1 has a 20% luminous intensity and the second LED unit D2 has an 80% intensity, the color temperature of the lighting device is 3000K*20%+6000K*80%.

The luminous intensity control of the LED units by the LED control units PWM control signals is a well-known art, and therefore detailed description of the technique is omitted herein.

In the embodiment, the lighting device further includes a memory unit 23 that is electrically connected to the wireless receiver module 21 and the power modulation module 22. The memory unit 23 stores the illumination assigning code and the color temperature assigning code that were lastly received from the wireless receiver module 21. When the wireless receiver module 21 receives a turn-on command signal, the power modulation module 22 reads the stored illumination assigning code and the color temperature assigning code from the memory unit 23, controls the firing angle of multiple cycles of the modulated power according to the illumination assigning code, controls the firing angle of the first number of successive cycles of the modulated power to be 0 degree, and then controls the firing angle of the multiple cycles of the modulated power according to the color temperature assigning code.

When the lighting device is turned on, for example, receiving a turn-on signal from a remote control device, the dimming control unit 13 reads the last received illumination assigning code and the color temperature assigning code that are stored in the memory unit, and sends the illumination assigning code and the color temperature assigning code while receiving the AC power by generating and outputting the modulated power. As a result, the first LED module 11 and the second LED module 12 recover the illuminous and color temperature state before being turned off, such that the user does not need to adjust the illuminous and color temperature of the lighting device every time.

Figure 4:
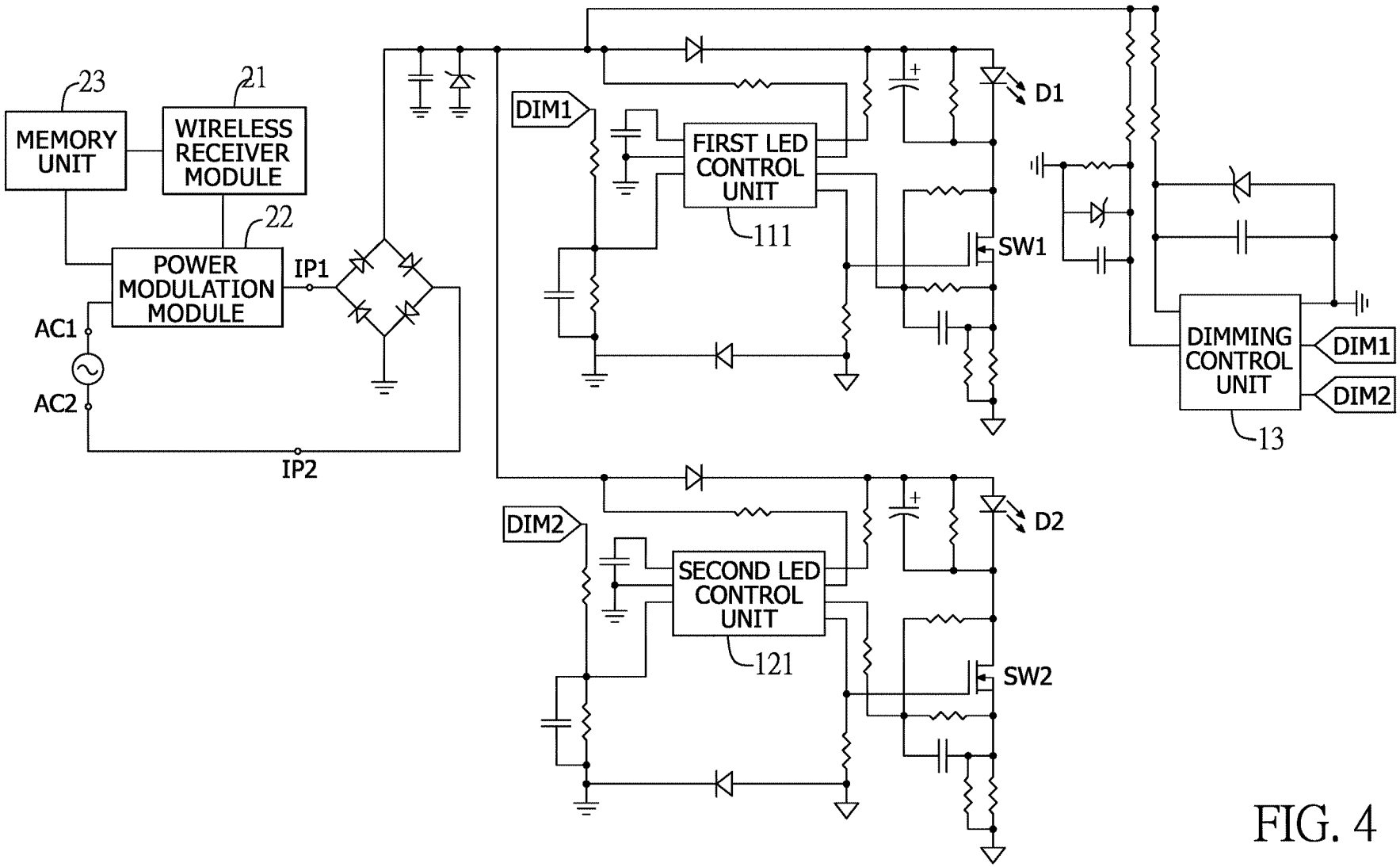
FIG. 4 is a circuit diagram of a preferred embodiment of the lighting device of the present invention.

FIG. 4 is a detailed circuitry diagram of the embodiment of the present invention.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. A lighting device with color temperature control function, comprising:

two modulated power input ends, receiving a modulated power via a power modulation module, wherein the modulated power is composed of multiple cycles of a sinewave, and each cycle of the sinewave has a firing angle;

a rectifier, electrically connected to the modulated power input ends to receive and rectify the modulated power, and having a rectifier output end to output a rectified modulated power;

a first LED module, electrically connected to the rectifier output end to receive the rectified modulated power;

a second LED module, electrically connected to the rectifier output end to receive the rectified modulated power; wherein a color temperature of the first LED module is different to a color temperature of the second LED module;

a dimming control unit, electrically connected to the first LED module and the second LED module, and having a power signal input end, wherein the power signal input end is electrically connected to the rectifier output end to receive the rectified modulated power; wherein the dimming control unit reads a lighting modulation command code, via a wireless receiver module and a firing angle control unit, that is carried in the modulated power according to the firing angle of each cycle of the sinewave, and respectively controls luminous intensity of the first LED module and the second LED module, such that the first LED module and the second LED module perform lighting with a specific combination of color temperatures.

2. The lighting device with color temperature control function as claimed in claim 1, wherein:

when the dimming control unit determines the firing angle of the cycle is a first firing angle, the dimming control unit records a first value; and when the dimming control unit determines the firing angle of the cycle is a second firing angle, the dimming control unit records a second value.

3. The lighting device with color temperature control function as claimed in claim 2, wherein at least one of the cycles of the sinewave has the firing angle of 0 degree;

wherein when the dimming control unit records a first number of successive cycles among the cycles of the sinewave having the firing angle of 0 degree, the dimming control unit determines the firing angle of the next second number of the successive cycles of the sinewave, and records the lighting modulation command code of second number bits accordingly.

4. The lighting device with color temperature control function as claimed in claim 1, wherein the firing angle of each cycle in the modulated power is smaller than a minimum power utilization phase angle.

5. The lighting device with color temperature control function as claimed in claim 1, wherein the dimming control unit stores a command chart;

wherein when the dimming control unit records the lighting modulation command code, the dimming control unit reads a first lighting control code and a second lighting control code that correspond to the lighting modulation command code in the command chart, outputs a first lighting control signal to the first LED module, and outputs a second lighting control signal to the second LED module accordingly.

6. The lighting device with color temperature control function as claimed in claim 1, wherein the first LED module includes:

a first LED unit;

a first switch, electrically connected with the first LED unit in series between the modulated power input end and a ground end, and having a first control end;

a first LED control unit, having a first control input end and a first control output end, wherein the first control input end is electrically connected to the dimming control unit, and the first control output end is electrically connected to the first control end of the first switch;

the second LED module includes:

a second LED unit, a second switch, electrically connected with the second LED unit in series between the modulated power input end and the ground end, and having a second control end;

a second LED control unit, having a second control input end and a second control output end, wherein the second control input end is electrically connected to the dimming control unit, and the second control output end is electrically connected to the second control end of the second switch.

7. The lighting device with color temperature control function as claimed in claim 1, further comprising:

two power input terminals, receiving an alternative current (AC) power;

the wireless receiver module, receiving a wireless control signal and generating the lighting modulation command code accordingly; and the power modulation module, electrically connected to the two power input terminals to receive the AC power, electrically connected to the wireless receiver module to receive the lighting modulation command code, and having two modulated power output ends; wherein the power modulation module controls the firing angle of each cycle of the AC power according to the lighting command code, thus generates the modulated power, and outputs the modulated power to the two modulated power output ends.

8. The lighting device with color temperature control function as claimed in claim 7, further comprising:

a triode AC semiconductor switch (TRIAC), electrically connected between the AC power input terminal and the two modulated power output ends, and having a control end;

the firing angle control unit, electrically connected to the wireless receiver module to receive the lighting modulation command code, and electrically connected to the control end of the TRIAC; wherein when a first bit of the lighting modulation command code is a first value, the firing angle control unit provides a PWM signal with a first duty ratio to the control end of the TRIAC; and when a second bit of the lighting modulation command code is a second value, the firing angle control unit provides a PWM signal with a second duty ratio to the control end of the TRIAC.

9. The lighting device with color temperature control function as claimed in claim 7, wherein the rectifier, the first LED module, the second LED module, and the dimming control unit are disposed on an LED light board;

wherein the wireless receiver module and the power modulation module are integrated in a ceiling fan-lighting device control device, and the LED light board is electrically connected to the ceiling fan-lighting device control device through two power lines to receive the modulated power.

10. The lighting device with color temperature control function as claimed in claim 7, further comprising:

a memory unit, electrically connected to the wireless receiver module and the power modulation module, and storing an illumination assigning code and a color temperature assigning code received from the wireless receiver module; wherein when the wireless receiver module receives a turn-on command signal, the power modulation module reads the stored illumination assigning code and the color temperature assigning code from the memory unit, controls the firing angle of multiple cycles of the modulated power according to the illumination assigning code, controls the firing angle of the first number of successive cycles of the modulated power to be 0 degree, and then controls the firing angle of the multiple cycles of the modulated power according to the color temperature assigning code.

* * * * *